US009630329B2

(12) United States Patent
Rhue

(10) Patent No.: US 9,630,329 B2
(45) Date of Patent: Apr. 25, 2017

(54) KITCHEN SCISSORS WITH A CURVED BLADE

(75) Inventor: Michael Christian Rhue, Milford, DE (US)

(73) Assignee: Michael Christian Rhue, Milford, DE (US)

( * ) Notice: Subject to any disclaimer, the term of this patent is extended or adjusted under 35 U.S.C. 154(b) by 0 days.

(21) Appl. No.: 13/566,997

(22) Filed: Aug. 3, 2012

(65) Prior Publication Data

US 2014/0033543 A1 Feb. 6, 2014

(51) Int. Cl.
*B26B 13/06* (2006.01)

(52) U.S. Cl.
CPC ..... *B26B 13/06* (2013.01)

(58) Field of Classification Search
CPC .. A61B 2010/0208; A24F 13/24; A24F 13/26; A22C 17/06; A01G 3/081; B26B 13/06; B26B 13/08
USPC ..... 30/276, 146, 152, 111, 112
See application file for complete search history.

(56) References Cited

U.S. PATENT DOCUMENTS 235,678 A * 12/1880 Gilman ..... 30/111
550,483 A * 11/1895 Carrier ..... 452/141
627,711 A * 6/1899 Smith ..... 131/251
835,912 A * 11/1906 Obermayer ..... 30/112
838,298 A * 12/1906 Brigs ..... 30/112
878,110 A * 2/1908 Bixby ..... 30/111
881,890 A * 3/1908 Barr ..... 30/120
921,801 A * 5/1909 Clauss ..... 30/112
950,692 A * 3/1910 Garrigus ..... 30/112
973,296 A * 10/1910 Peddle ..... 30/233
1,013,889 A * 1/1912 Newman ..... 30/112
1,024,924 A * 4/1912 Brunhoff ..... 30/112
1,094,338 A * 4/1914 Leisegang ..... 131/253
1,096,219 A * 5/1914 Bippart ..... 30/112
1,096,274 A * 5/1914 Simsarian ..... 30/112
1,098,952 A * 6/1914 Merrill ..... 30/111
1,219,203 A * 3/1917 Walker ..... 7/156
1,257,383 A * 2/1918 Olson ..... 401/52
1,359,164 A * 11/1920 Giudice et al. ..... 606/205
1,776,283 A * 9/1930 Harasimiak ..... 7/160
1,816,056 A * 7/1931 Richard ..... 30/257
2,136,414 A * 11/1938 Clements ..... 606/174
D171,837 S * 3/1954 Blanchaert ..... D8/57
2,760,264 A * 8/1956 Javits ..... 30/131
2,839,830 A * 6/1958 Neiman, Jr. ..... 30/147
(Continued)

*Primary Examiner* — Sean Michalski
(74) *Attorney, Agent, or Firm* — Law Office of Lyman H. Smith

(57) ABSTRACT

Kitchen scissors are curved and have a single or multiple blade for safer, faster and more efficient slicing of food, for example. The scissors can be used for various items, such as for cutting meat, vegetables and other food products. The curved design of the scissor blades allows a user to easily operate the scissors to cut items disposed against a horizontal surface without having to uncomfortably and unsafely twist one's wrist as would be required with conventional straight-blade scissors. The scissors can have multiple blades, spaced apart a desired "bite-sized" length, to make cutting food products even faster. The hooked tip not only improves the slicing action by lifting the food ever so slightly during cutting but such hooked tips also have the additional advantage of grabbing food with a tong effect prior to slicing.

10 Claims, 2 Drawing Sheets

(56) References Cited

U.S. PATENT DOCUMENTS

| | | | | | |
|---|---|---|---|---|---|
| 2,980,995 | A | * | 4/1961 | Booth | 30/144 |
| 3,174,268 | A | * | 3/1965 | Fernandez | 56/241 |
| 4,285,344 | A | * | 8/1981 | Marshall | 606/174 |
| 4,315,369 | A | * | 2/1982 | Borow | 30/257 |
| D278,117 | S | * | 3/1985 | Smith | D8/57 |
| 4,635,363 | A | * | 1/1987 | Chapin | 30/257 |
| D310,714 | S | * | 9/1990 | Dolwick | D24/148 |
| 5,074,046 | A | * | 12/1991 | Kolesky | 30/259 |
| 5,153,997 | A | * | 10/1992 | Chiavaras et al. | 30/257 |
| D331,179 | S | * | 11/1992 | Omichi | D8/57 |
| 5,497,522 | A | * | 3/1996 | Chen | 7/128 |
| 5,600,891 | A | * | 2/1997 | Orgal | 30/226 |
| 5,724,688 | A | * | 3/1998 | Chen | 7/128 |
| 5,996,592 | A | * | 12/1999 | Choy | 132/200 |
| 6,006,432 | A | * | 12/1999 | Cachot | 30/112 |
| 6,019,021 | A | * | 2/2000 | Keyvani | 81/416 |
| 6,079,107 | A | * | 6/2000 | Horvath | 30/233.5 |
| 6,125,546 | A | * | 10/2000 | Laws et al. | 30/257 |
| 6,216,346 | B1 | * | 4/2001 | Wechsler | 30/113 |
| 6,249,976 | B1 | * | 6/2001 | Osame | 30/199 |
| 6,434,832 | B1 | * | 8/2002 | Garrett | 30/226 |
| RE39,286 | E | * | 9/2006 | Silver et al. | 30/134 |
| 2002/0020067 | A1 | * | 2/2002 | Silver et al. | 30/226 |
| 2003/0229371 | A1 | * | 12/2003 | Whitworth | 606/174 |
| 2004/0078982 | A1 | * | 4/2004 | Yeh | 30/226 |
| 2007/0294897 | A1 | * | 12/2007 | Chen | 30/254 |
| 2008/0178469 | A1 | * | 7/2008 | Gutman | 30/111 |
| 2008/0262493 | A1 | * | 10/2008 | Sutter | 606/49 |
| 2009/0183742 | A1 | * | 7/2009 | Strasheim | 131/248 |
| 2010/0257741 | A1 | * | 10/2010 | Lin et al. | 30/112 |

* cited by examiner

KITCHEN SCISSORS WITH A CURVED BLADE

BACKGROUND OF THE INVENTION

The present invention relates to kitchen scissors and, more particularly, to kitchen scissors that are hooked and curved with a single pair or multiple pairs of curved blades for grabbing/gripping and faster slicing of food into more convenient bite sizes.

Using knives in cooking will most certainly always be around but there are specific situations while cooking and eating where a knife/fork is primitive, slower and can even be an unnecessary risk of injury.

Typical kitchen scissors are only good for trimming fat from meat and such and would not usually be used for quick cutting methods, like cutting carrots for soup, chopping up a salad, etc. Moreover, as mentioned above, knives can be risky and slow to use. Additionally, in a family setting at the dinner table, knives are again slow and a risky item to have around children.

As can be seen, there is a need for an improved kitchen scissors that can be used for quick, convenient, time saving cutting methods.

SUMMARY OF THE INVENTION

In one aspect of the present invention, scissors comprise an upper hook tipped blade; a lower hook tipped blade; a pivot point pivotably connecting the upper hook tipped blade with the lower hook tipped blade; and handles attached to one end of the upper hook tipped blade and the lower hook tipped blade, wherein a curve is disposed in the blades between the pivot point and an end of the blades.

In another aspect of the present invention, scissors comprise an upper hook tipped blade; a lower hook tipped blade; a screw passing through the upper hook tipped blade and the lower hook tipped blade, the screw pivotably connecting the upper hook tipped blade with the lower hook tipped blade, the screw being secured by a nut; and handles attached to one end of the upper hook tipped blade and the lower hook tipped blade, wherein a curve is disposed in the blades between the pivot point and an end of the blades, the curve being from about 45 to about 90 degrees.

In a further aspect of the present invention, scissors comprise a primary upper hook tipped blade; a secondary upper hook tipped blade; a primary lower hook tipped blade; a secondary lower hook tipped blade; a screw passing through the primary and secondary upper hook tipped blades and the primary and secondary lower hook tipped blades, the screw pivotably connecting the primary and secondary upper hook tipped blades with the primary and secondary lower hook tipped blades, the screw being secured by a nut; and handles attached to one end of the upper hook tipped blade and the lower hook tipped blade, wherein a curve is disposed in the blades between the pivot point and an end of the blades.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides kitchen scissors that are hooked and curved and have a single pair or multiple pairs of blades for gripping/grabbing and safer, faster and more efficient slicing of food, for example. The scissors can be used for various items, such as for cutting meat, vegetables and a wide array of other food products. The curved design of the scissor blades allows a user to easily operate the scissors to cut items disposed against a horizontal surface without having to uncomfortably and unsafely twist one's wrist as would be required with conventional straight-blade scissors. The scissors can have multiple pairs of blades spaced apart at a desired "bite-sized" length, to make cutting food products even faster. Such "bite-sized" spacing may vary depending on age groups such as babies, tots, kids, teens, adults and even the elderly and handicapped.

The hooked tip not only improves the slicing action by lifting the food ever so slightly during cutting but such hooked tips also have the additional advantage of grabbing food with a tong effect prior to slicing. For example, these hooked scissors can be used to grab a chicken breast or piece of steak from a serving plate in the same fashion as a pair of traditional tongs thereby combining two utensils into one.

Figure 1:
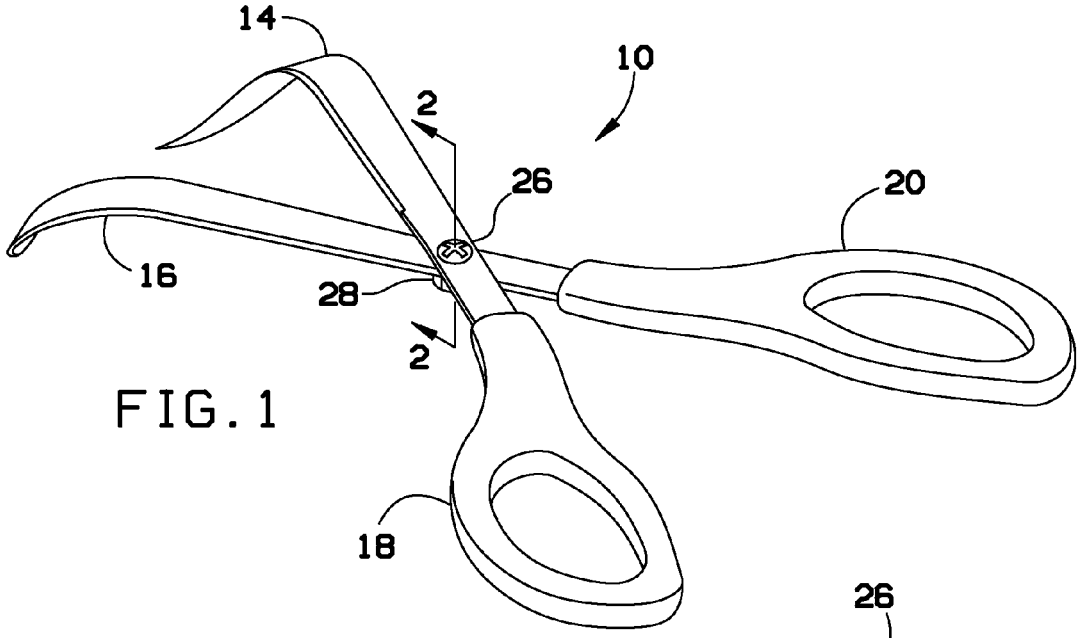
FIG. 1 is a top perspective view of kitchen scissors according to an exemplary embodiment of the present invention.
Figure 2:
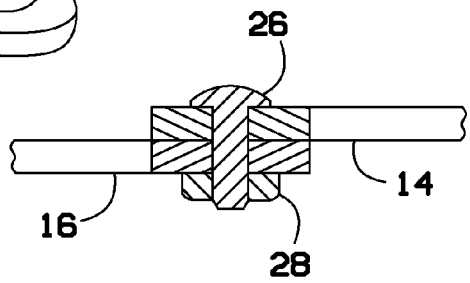
FIG. 2 is a cross sectional view taken along line 2-2 of FIG. 1.
Figure 3:
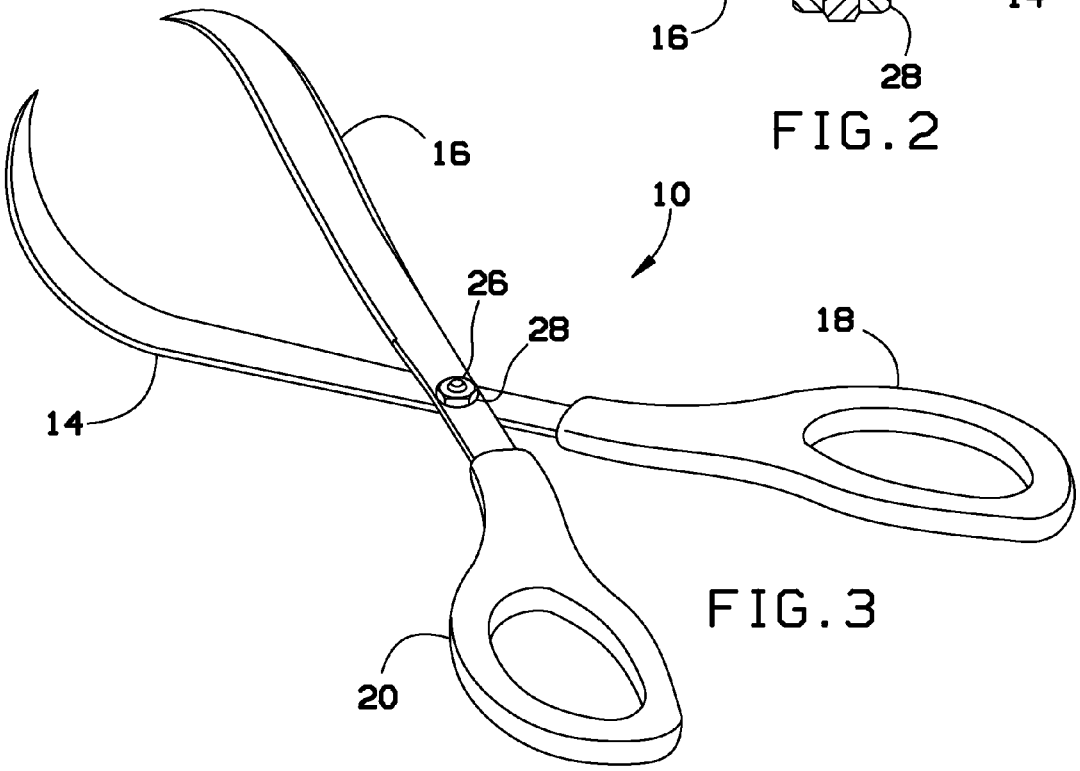
FIG. 3 is a bottom perspective view of the kitchen scissors of FIG. 1.

Referring to FIGS. 1 through 3, a single blade scissors 10 includes an upper hook tipped blade 14 and a lower hook tipped blade 16 joined together at a pivot point, such as a screw 26 secured by a nut 28, to permit the blades 14, 16 to pivot relative to each other. Handles 18, 20 can be attached at the non-cutting ends of the blades 14, 16. The blades 14, 16 can have a curve at cuttings end thereof. Typically the curve is approximately 45 to 90 degrees from the plane of the handles 18, 20. The curve is disposed between the pivot point and the tip of the blades 14, 16. The curve allows a user to keep the handles 18, 20 almost parallel to a horizontal surface while cutting items disposed on the horizontal surface.

Figure 4:
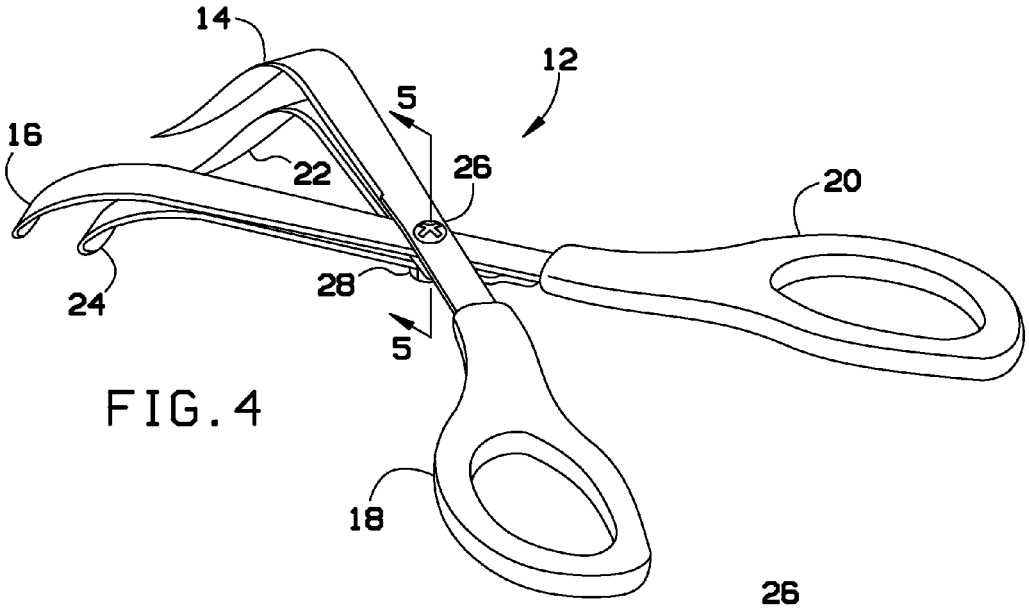
FIG. 4 is a top perspective view of kitchen scissors having multiple blades, according to another exemplary embodiment of the present invention.
Figure 5:
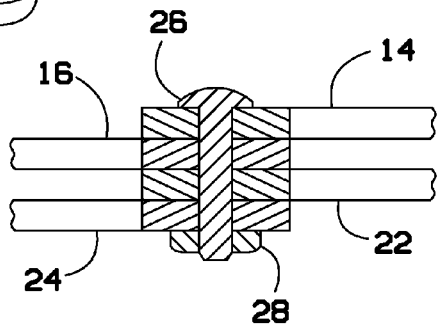
FIG. 5 is cross sectional view taken along line 5-5 of FIG. 4.
Figure 6:
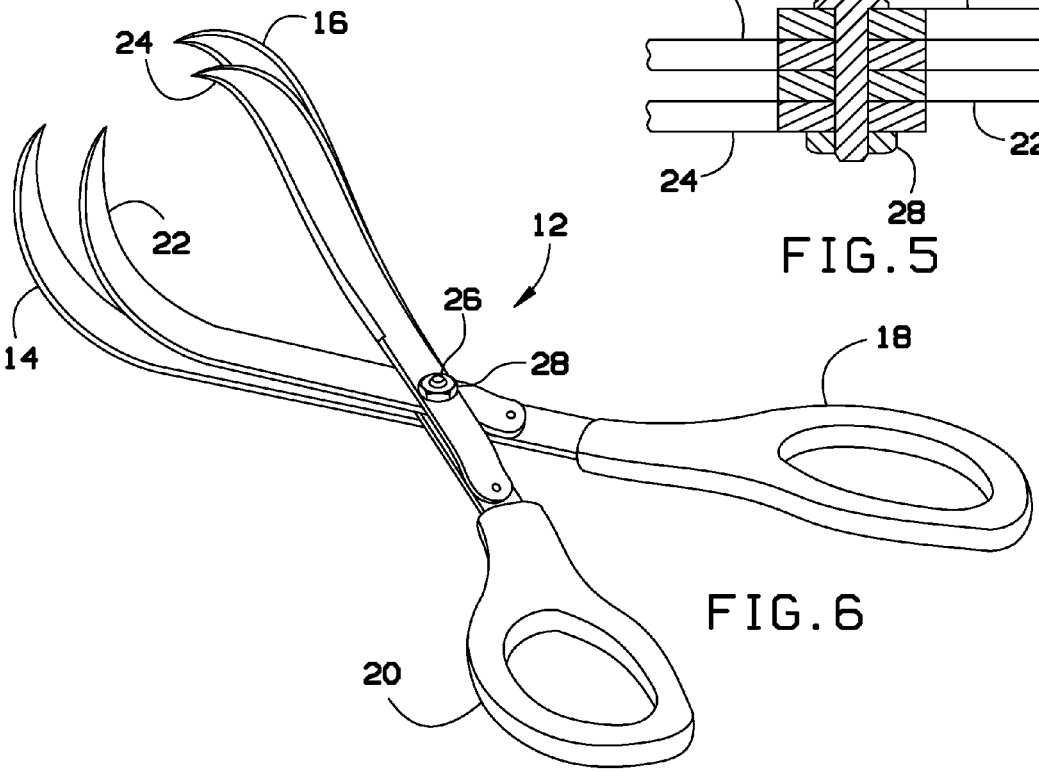
FIG. 6 is a bottom view of the kitchen scissors of FIG. 4.

Referring now to FIGS. 4 through 6, a double blade scissors 12 can be designed similar to the single blade scissors 10 described above, except that, in addition to the upper and lower hooked tipped blades 14, 16, the scissors 12 includes a secondary upper hook tipped blade 22 and a secondary lower hook tipped blade 24. The blades 14, 16, 22, 24 can be disposed such that when a user closed the handles 18, 20, the upper hook tipped blade 14 closes against the lower hooked tipped blade 16 and the secondary upper hooked tipped blade 22 closes against the secondary lower hooked tipped blade 24. The upper blades 14, 22 and the lower blades 16, 24 can be spaced apart a desired distance. This distance may be from about ½ inch to about 2 inches, depending on application. Typically, the upper blades 14, 22 and the lower blades 16, 24 are spaced apart up to an inch, providing bite-sized cuts when used to cut food.

The scissors of the present invention can be used, for example, to quickly, easily and safely cut a child's food, for example, a hot dog, into bite-sized pieces.

While the figures show a single and a double blade configuration, multiple blades, for example, a triple blade or even a quadruple blade configuration is contemplated within the scope of the present invention.

The scissors can be made from various materials. Typically, the blades can be made of a metal, such as stainless steel, and the handles can be made of any suitable material, such as plastic, steel, wood, composite, or the like. In some embodiments, the blades can be made of other materials, such as a hard plastic. Such hard plastic scissors may be useful for cutting lighter food items, for example, or food items that could wilt, such as lettuce, if cut by a metal blade.

It should be understood, of course, that the foregoing relates to exemplary embodiments of the invention and that modifications may be made without departing from the spirit and scope of the invention as set forth in the following claims.

What is claimed is:

1. Scissors comprising:

an upper hook tipped blade having a first hook tip at a first hook tip first end;

a lower hook tipped blade having a second hook tip at a second hook tip first end;

a pivot point pivotably connecting the upper hook tipped blade with the lower hook tipped blade; and handles attached to a second end of the upper hook tipped blade and the lower hook tipped blade the second end opposite the first hook tip first end and the second hook tip first end of the upper hook tipped blade and the lower hook tipped blade, respectively, wherein a curve is disposed in the blades between the pivot point and the first hook tip first end and the second hook tip first end of the upper hook tipped blade and the lower hook tipped blade;

a first blade axis, defined as a lengthwise axis of the upper hook tipped blade and the lower hook tipped blade between the handles and the pivot point, is bent in a first direction at the curve;

a second blade axis, defined as a lengthwise axis of the upper hook tipped blade and the lower hook tipped blade between the curve and the first hook tip first end and the second hook tip first end, respectively, is bent in a second direction, different from the first direction;

the first hook tip and the second hook tip bend away from the second blade axis to point toward each other when the scissors are in an open configuration; and a cutting edge of the upper hook tipped blade, prior to initiating an upper blade bend to form the first hook tip, lies in a plane, and a second cutting edge of the lower hook tipped blade, prior to initiating a lower blade bend to form the second hook tip, lies in another plane.

2. The scissors of claim 1, wherein the pivot point includes a screw secured with a nut.

3. The scissors of claim 1, wherein:

the upper hook tipped blade includes a primary upper hook tipped blade and a secondary upper hook tipped blade; and the lower hooked tipped blade includes a primary lower hook tipped blade and a secondary lower hook tipped blade.

4. The scissors of claim 3, wherein the primary upper hook tipped blade and the secondary upper hook tipped blade, and the primary lower hook tipped blade and the secondary lower hook tipped blade are spaced apart from each other by a predetermined spacing.

5. The scissors of claim 1, wherein the curve bends the upper hook tipped blade and the lower hook tipped blade from about 45 to about 90 degrees.

6. Scissors comprising:

an upper hook tipped blade having a first hook tip at a first hook tip first end;

a lower hook tipped blade having a second hook tip at a second hook tip first end;

a screw passing through the upper hook tipped blade and the lower hook tipped blade, the screw pivotably connecting the upper hook tipped blade with the lower hook tipped blade, the screw being secured by a nut; and handles attached to a second end of the upper hook tipped blade and the lower hook tipped blade the second end opposite the first hook tip first end and the second hook tip first end of the upper hook tipped blade and the lower hook tipped blade, respectively, wherein a curve is disposed in the blades between the pivot point and the first hook tip first end and the second hook tip second end of the upper hook tipped blade and the lower hook tipped blade, the curve being from about 45 to about 90 degrees;

a first blade axis, defined as a lengthwise axis of the upper hook tipped blade and the lower hook tipped blade between the handles and the pivot point, is bent in a first direction at the curve;

a second blade axis, defined as a lengthwise axis of the upper hook tipped blade and the lower hook tipped blade between the curve and the first hook tip first end and the second hook tip first end, respectively, is bent in a second direction, different from the first direction;

the first hook tip and the second hook tip bend away from the second blade axis to point toward each other when the scissors are in an open configuration; and a cutting edge of the upper hook tipped blade, prior to initiating an upper blade bend to form the first hook tip, lies in a plane, and a second cutting edge of the lower hook tipped blade, prior to initiating a lower blade bend to form the second hook tip, lies in another plane.

7. The scissors of claim 6, wherein:

the upper hook tipped blade includes a primary upper hook tipped blade and a secondary upper hook tipped blade; and the lower hooked tipped blade includes a primary lower hook tipped blade and a secondary lower hook tipped blade.

8. The scissors of claim 7, wherein the primary upper hook tipped blade and the secondary upper hook tipped blade, and the primary lower hook tipped blade and the secondary lower hook tipped blade are spaced apart from each other by a predetermined spacing.

9. Scissors comprising:

a primary upper hook tipped blade having a first hook tip at a primary upper hook tip first end;

a secondary upper hook tipped blade, having a second hook tip at a secondary upper hook tip first end;

a primary lower hook tipped blade having a third hook tip at a primary lower hook tip first end;

a secondary lower hook tipped blade having a fourth hook tip at a secondary lower hook tip first end;

a screw passing through the primary and secondary upper hook tipped blades and the primary and secondary lower hook tipped blades, the screw pivotably connecting the primary and secondary upper hook tipped blades with the primary and secondary lower hook tipped blades, the screw being secured by a nut; and handles attached to a second end of the primary upper hook tipped blade and the primary lower hook tipped blade the second end opposite the primary upper hook tip first end and the primary lower hook tip first end of the primary upper hook tipped blade and the primary lower hook tipped blade, respectively, wherein a curve is disposed in each of the blades between the pivot point and the first, second, third and fourth hook tips;

a first blade axis, defined as a lengthwise axis of each of the blades between the handles and the pivot point, is bent in a first direction at the curve;

a second blade axis, defined as a lengthwise axis of each of the blades between the curve and each of the hook tip first ends of each of the blades, respectively, is bent in a second direction, different from the first direction;

at least the first hook tip and the second hook tip bend away from the second blade axis to point toward each other when the scissors are in an open configuration; and a cutting edge of the upper hook tipped blade, prior to initiating an upper blade bend to form the first hook tip, lies in a plane, and a second cutting edge of the lower hook tipped blade, prior to initiating a lower blade bend to form the second hook tip, lies in another plane.

10. The scissors of claim 9, wherein the curve is from about 45 to about 90 degrees.

* * * * *